US009526349B2

(12) United States Patent
Lafleche et al.

(10) Patent No.: US 9,526,349 B2
(45) Date of Patent: Dec. 27, 2016

(54) PATIENT SUPPORT COVER

(71) Applicant: Stryker Corporation, Kalamazoo, MI (US)

(72) Inventors: Patrick Lafleche, Kalamazoo, MI (US); Christopher Cate, Holland, MI (US); Todd Zeilinger, Holland, MI (US); Kent Douglas Pilcher, Holland, MI (US); Stephen F. Peters, Hickory Corners, MI (US); Michael T. Brubaker, Vicksburg, MI (US); Manikantan Seshradinathan, Portage, MI (US); David Allen Dunlap, Portage, MI (US); Ryan Ross, Lawton, MI (US)

(73) Assignee: Stryker Corporation, Kalamazoo, MI (US)

( * ) Notice: Subject to any disclaimer, the term of this patent is extended or adjusted under 35 U.S.C. 154(b) by 196 days.

(21) Appl. No.: 14/308,131

(22) Filed: Jun. 18, 2014

(65) Prior Publication Data

US 2014/0373279 A1 Dec. 25, 2014

Related U.S. Application Data

(60) Provisional application No. 61/837,067, filed on Jun. 19, 2013.

(51) Int. Cl.

| | |
|---|---|
| ***A47C 27/10*** | (2006.01) |
| ***A47C 27/08*** | (2006.01) |
| ***A61G 7/05*** | (2006.01) |
| ***A61G 7/00*** | (2006.01) |
| *A61G 7/057* | (2006.01) |

(52) U.S. Cl.

CPC ..... *A47C 27/10* (2013.01); *A47C 27/088* (2013.01); *A61G 7/001* (2013.01); *A61G 7/05* (2013.01); *A61G 7/05776* (2013.01); *A61G 2205/50* (2013.01)

(58) Field of Classification Search

CPC ..... A47C 27/10
USPC ..... 5/710, 713, 654
See application file for complete search history.

(56) References Cited

U.S. PATENT DOCUMENTS

| | | | | |
|---|---|---|---|---|
| 3,859,678 | A | 1/1975 | Davis | |
| 5,794,289 | A * | 8/1998 | Wortman | A61G 7/001 5/423 |
| 6,158,070 | A | 12/2000 | Bolden et al. | |
| 6,370,716 | B1 * | 4/2002 | Wilkinson | A61G 5/1043 297/314 |

(Continued)

FOREIGN PATENT DOCUMENTS

WO 2014039661 A1 3/2014

OTHER PUBLICATIONS

PCT International Search Report regarding Application No. PCT/US2014/043186 filed Jun. 19, 2014, corresponding to U.S. Appl. No. 14/308,131.

(Continued)

*Primary Examiner* — Fredrick Conley
(74) *Attorney, Agent, or Firm* — Warner Norcross & Judd LLP

(57) ABSTRACT

A cover for a mattress for supporting a patient is adapted to provide a generally smooth top surface over the mattress while still accommodating the movement of portions of the mattress or changes in thickness of the mattress, for example, when turning the patient.

17 Claims, 11 Drawing Sheets

(56) References Cited

U.S. PATENT DOCUMENTS

| | | | | |
|---|---|---|---|---|
| 7,228,579 | B2 | 6/2007 | Tidwell | |
| 7,617,555 | B2 | 11/2009 | Romano et al. | |
| 8,006,333 | B2 | 8/2011 | Genaro et al. | |
| 2010/0146709 | A1 * | 6/2010 | Lafleche ..... | A61G 7/05715 5/713 |

OTHER PUBLICATIONS

PCT International Written Opinion regarding Application No. PCT/US2014/043186 filed Jun. 19, 2014, corresponding to U.S. Appl. No. 14/308,131.

* cited by examiner

PATIENT SUPPORT COVER

CROSS-REFERENCE TO RELATED APPLICATIONS

This application claims the benefit of U.S. provisional application Ser. No. 61/837,067, filed Jun. 19, 2013, entitled PATIENT SUPPORT COVER which is incorporated by reference herein in its entirety.

This application is also related to U.S. provisional applications Ser. No. 61/697,010 filed Sep. 5, 2012, entitled PATIENT SUPPORT, and Ser. No. 61/507,371, filed Jul. 13, 2011, entitled PATIENT/INVALID HANDLING SUPPORT; copending U.S. application Ser. No. 13/548,591, filed Jul. 13, 2012, entitled PATIENT/INVALID HANDLING SUPPORT; U.S. copending application Ser. No. 13/022,326, filed Feb. 7, 2011, entitled PATIENT/INVALID HANDLING SUPPORT; U.S. copending application Ser. No. 13/022,372, filed Feb. 7, 2011, entitled PATIENT/INVALID HANDLING SUPPORT; U.S. copending application Ser. No. 13/022,382, filed Feb. 7, 2011, entitled PATIENT/INVALID HANDLING SUPPORT; U.S. copending application Ser. No. 13/022,454, filed Feb. 7, 2011, entitled PATIENT/INVALID HANDLING SUPPORT; U.S. copending application Ser. No. 12/640,770, filed Dec. 17, 2009, entitled PATIENT SUPPORT; and U.S. copending application Ser. No. 12/640,643, filed Dec. 17, 2009, entitled PATIENT SUPPORT, all of which are incorporated by reference herein in their entireties.

TECHNICAL FIELD AND BACKGROUND OF THE INVENTION

The present invention generally relates to a patient support, and more particularly to a patient support cover for a hospital bed.

SUMMARY OF THE INVENTION

The present disclosure describes a cover for a patient support, such as a mattress, for supporting a patient on a bed, such as a hospital bed. The cover is adapted to provide a generally smooth upper surface that extends over the mattress while still accommodating the movement of portions of the mattress or changes in thickness of the mattress, for example, when turning the patient. Optionally, the cover may be configured to follow the surface topology of the mattress, including a mattress with raised bolsters and/or a mattress with a raised head end.

In one embodiment, a patient support includes a cushioning layer and a cover with an upper panel of flexible fabric extending over an upper side of the cushioning layer and two side panels joined with the upper panel. The side panels extend along the sides of the cushioning layer and are secured at the bottom side of the cushioning layer. The side panels are configured to contract or expand to accommodate variations in height of the cushioning layer to allow the upper panel to remain generally smooth even when the cushioning layer undergoes a change in its surface topology.

In one aspect, the cushioning layer comprises a cushioning system. For example, the cushioning system may include a plurality of bladders or a gel layer or a foam layer or a combination thereof.

In a further aspect, the side panels are secured at the bottom side of the cushioning layer by a bottom panel that extends under the bottom side of the cushioning layer.

In another embodiment, a patient support includes a cushioning layer and a cover with an upper side for extending over the cushioning layer and two sides joined extending downwardly from the upper side. The sides extend along the sides of the cushioning layer and are secured at the bottom side of the cushioning layer. The sides of the cover are configured to contract or expand to accommodate variations in height of the cushioning layer to allow the upper side to remain generally smooth even when the cushioning layer undergoes a change in its surface topology.

In one aspect, the cover is formed from an upper panel, which forms the upper side, and the sides are formed by side panels that are joined with the upper panel. The cover further includes a bottom panel that is joined with the side panels to thereby secure the side panels at the lower side of the cushioning layer.

In a further aspect, the cushioning layer includes a non-planar surface topology, for example, a surface topology with one or more curves to generally follow one or more curves of a person's body when lying on the patient support. Optionally, the sides and the upper side of the cover may be joined by a non-linear seam or seams to follow the non-linear surface topology.

In any of the above, the sides or side panels may be formed from a liquid impermeable fabric. Further, the upper panel may be formed from a liquid impermeable material.

In yet another embodiment, a cover includes an upper panel of flexible fabric for extending over a top side of a mattress, a lower panel for extending under a bottom side of a mattress, and end panels and side panels joined with the upper panel and with the lower panel. The side panels extend along the sides of the mattress and have upper and lower edges. The upper edges are joined with the upper panel, and the lower edges are joined with lower panel. The side panels are configured to prevent liquid intrusion into the mattress and further so that their upper and lower edges separate and/or diverge to accommodate variations in height of the mattress to allow the upper panel to remain generally smooth even when the mattress undergoes a change in its surface topology.

In any of the above, the cover may include a zipper. In addition, each of the side panels includes an upper side panel portion and a lower side panel portion. The upper side panel portions are joined with the upper panel. The lower panel portions are joined with the lower panel, and the zipper joins the upper side panel portions with the lower side panel portions.

In a further aspect, each of the upper side panel portions includes a flap of fabric extending over the zipper when the zipper is closed. For example, the flap of fabric may be formed by a folded loop of fabric.

In yet another aspect, each of the upper side panel portions includes a fold, which includes at least a portion that at least partially unfolds from an unexpanded configuration to an expanded configuration when the respective side of cushioning layer or mattress to which the fold is adjacent increases in height, for example, when it is raised to turn a patient.

In yet a further aspect, the folds are biased in its non-expanded configuration such that when the mattress or cushioning layer increases in height, at least a portion of each fold will at least partially unfold but when the mattress or cushioning layer decreases in height, the respective fold will generally return to its non-expanded configuration.

In another aspect, each fold may be biased in its unexpanded configuration by one or more elastic strands. For example, the strand or strands may extend between the upper panel and the lower panel. In this manner when the upper side of the mattress or cushioning layer raises relative to the lower side, the strand or strands are stretched and the upper side panel portion at least partially unfolds. When the mattress or cushioning layer is no longer in a raised position, the strand or strands pull on the upper panel to return it its un-raised position allowing the upper side panel portion to return its unexpanded configuration.

In any of the above, the cushioning layer or mattress may include a plurality of inflatable bladders.

According to yet another aspect, the inflatable bladders may be supported on a foam crib, also enclosed in the cover.

In addition, the cushioning layer or mattress optionally includes turning bladders positioned in the cover to allow turning of a patient supported on the patient support. For example, the turning bladders may be located beneath the foam crib.

In another aspect, the cover is configured to flow air beneath the cover to manage moisture that may build up under the cover, which is formed from a material that prevents liquid intrusion but allows gas and moisture to flow through the cover.

Before the embodiments of the invention are explained in more detail below, it is to be understood that the invention is not limited to the details of operation or to the details of construction and the arrangement of the components set forth in the following description or illustrated in the drawings. The invention may be implemented in various other embodiments and is capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE PREFERRED EMBODIMENTS

Figure 1:
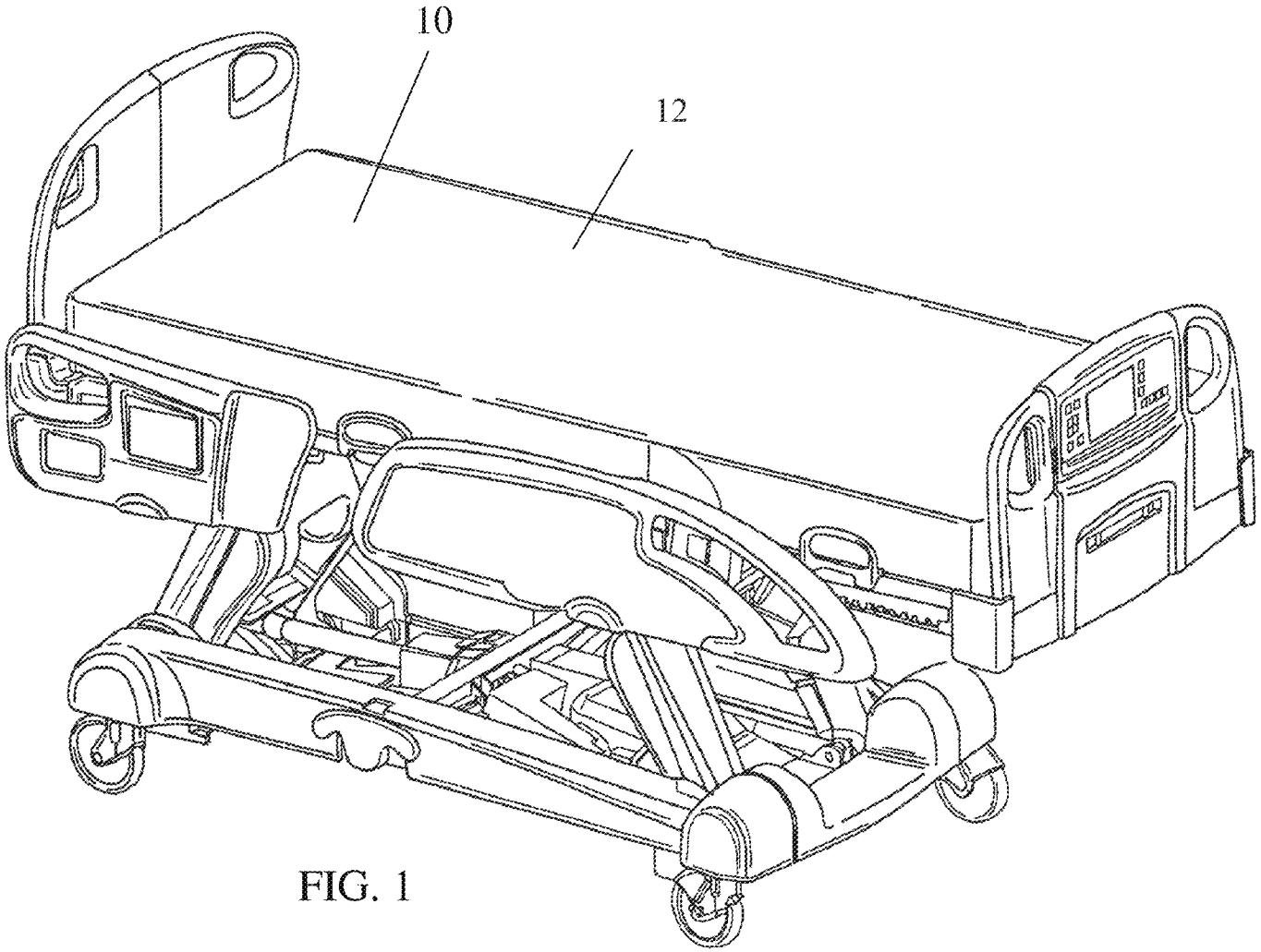
FIG. 1 is a perspective view a patient support and cover shown mounted to a patient support apparatus, for example, a hospital bed.

Referring to FIG. 1, the numeral 10 generally designates a patient support. While described as a "patient" support, it should be understood that "patient" is to be construed broadly to include not only people undergoing medical treatment but also invalids and other persons, such as long term care persons, who may or may not be undergoing medical treatment. Further, while patient support 10 is illustrated as a mattress, it will be understood that patient support 10 may take on other forms, such as pads, cushions, including cushions for a wheelchair or a stationary chair pads. Patient support 10 provides support to a patient's body and, further, may be adapted to provide therapy or treatment to the patient, for example, rotation therapy, percussion therapy, or vibration therapy or the like, as described in the referenced applications.

Referring again to FIG. 1, patient support 10 is supported on a patient support apparatus 12 that, in this particular embodiment, is illustrated as a hospital bed. However, patient support apparatus 12 may take on other forms besides hospital beds, such as, but not limited to, long term care beds, cots, stretchers, operating tables, gurneys, and the like. Further, patient support apparatus 12 may be a conventional support apparatus that is commercially available and that merely provides a supporting function for patient support 10.

For example, patient support apparatus 12 may include one or more controls that are integrated therein and which are used in controlling one or more functions of patient support 10, as discussed in the referenced applications. For example, electrical connectors may be provided for establishing an electrical link between a user interface that is positioned on, or integrated into, a barrier of patient support apparatus 12. The user interface may take on a variety of different forms, such as, but not limited to, a touch screen, a Liquid Crystal Display (LCD), a plurality of buttons, switches, knobs, or the like, or any combination of these components, which allows a user to control the operation of patient support 10. The connection between the interface and patient support 10 may take on different forms, including a direct electrical cable that runs from the footboard to patient support 10, for example by way of electrical connectors that electrically couple the user interface to circuitry supported on or in the frame of the bed, and/or by wireless communication, such as disclosed in commonly assigned U.S. patent application Ser. No. 13/802,992, filed Mar. 14, 2013 by applicants Michael Hayes et al. and entitled COMMUNICATION SYSTEMS FOR PATIENT SUPPORT APPARATUSES, the complete disclosure of which is hereby incorporated herein by reference. For more exemplary details of a suitable hospital bed reference is made to the beds described in U.S. Pat. Nos. 8,006,332; 7,690,059; 7,805,784; 7,962,981; and 7,861,334, all commonly owned by Stryker Corporation of Kalamazoo, Mich., which are herein incorporated by reference in their entireties.

Figure 2:
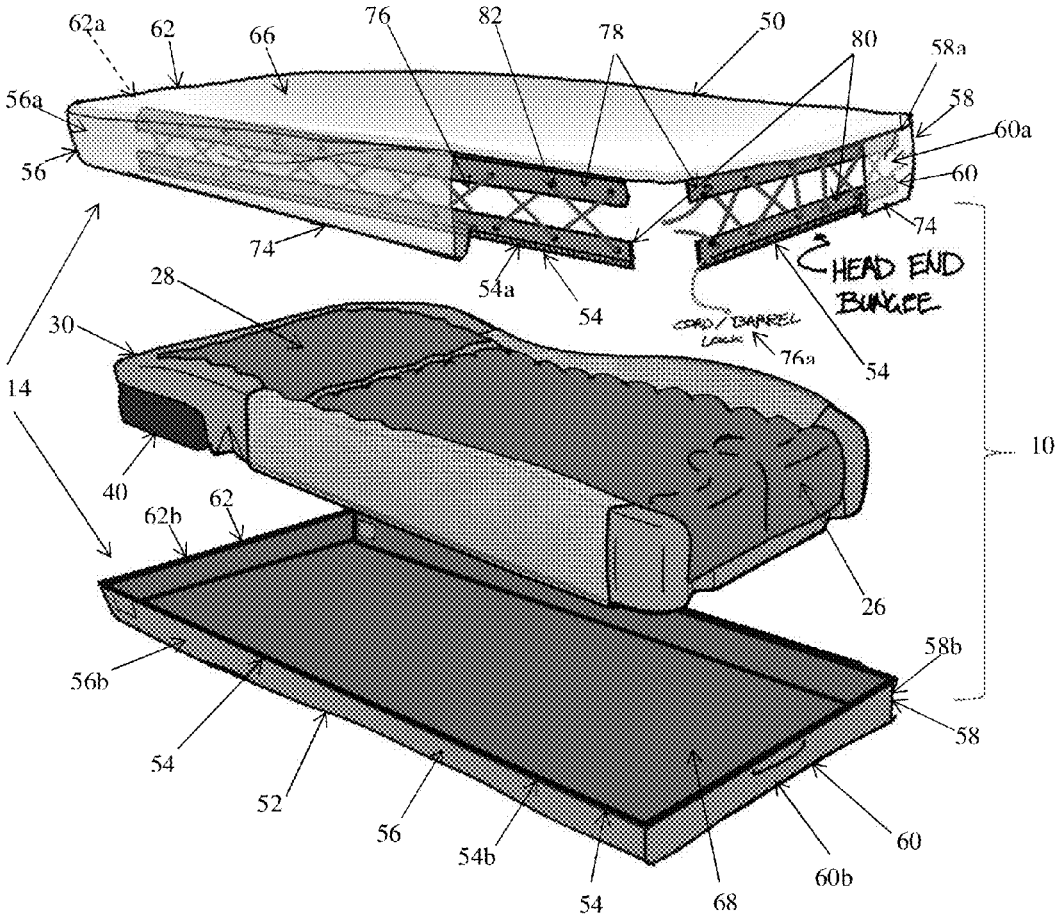
FIG. 2 is an exploded perspective view of the patient support and cover of FIG. 1.

Referring to FIG. 2, patient support 10 includes a cover 14. For example, cover 14 may be formed from a flexible knit material, such as a flexible knit nylon or a nylon-like fabric, which provides a high breathability rate to facilitate moisture management. Additionally, cover 14 may be formed with the knit fibers on the patient facing side of the cover and with an inner surface formed by a stretchy elastomeric membrane that is stretchable so as not to reduce, if not eliminate, any interference with the patient immersion into support 10. Furthermore, as described in copending U.S. patent application Ser. No. 61/697,010, filed Sep. 5, 2012, entitled PATIENT SUPPORT, refiled as U.S. Non-provisional Ser. No. 14/019,353 filed Sep. 5, 2013, entitled PATIENT SUPPORT, which are incorporated by reference herein in their entireties, cover 14 optionally encloses one or more blowers or fans for circulating air through the support, as part of a low air loss system. Therefore, cover 14 may incorporate one or more open mesh panels to allow air to be drawn into or blown out of the cover 14.

In another aspects, also described in the above copending U.S. patent applications Ser. No. 61/697,010 and Ser. No. 14/019,353, cover 14 may include one or more indicia on its surface. For example, cover 14 may include indicia to define the preferred location for a patient on patient support 10. The indicia may include a demarcation, such as a line, that defines the overall general area in which the patient should be positioned in the supine position and additional demarcations, also for example lines, that define the foot area, the thigh and seat areas, the back areas, and the head area of the patient support. In this manner, when a patient is located in the general area and also generally aligned with the sub-areas, the patient will be properly aligned with the support cushioning layers and turning bladders that are configured to provide the appropriate cushioning and functionality to that region of the patient's body.

In addition to the demarcation lines that identify the different areas/sections of the support, other indicia may be applied, for example, graphical instructions, representations of the underlying cushioning layers (e.g. the gel or bladders), as well as the location of optional percussion/vibration and/or turning bladders to facilitate the proper positioning of the patient.

The various demarcations, which for example indicate the different areas of support, i.e. thigh and back support areas, foot support areas, and head support areas, may be applied to the underlying sheet that forms the cover using a heat transfer process. For example, ink that is applied to a carrier sheet may be transferred onto the fabric that forms the cover using heat. In this manner, the ink does not simply coat the fabric, as is the case with silk screening, and instead merges with the fabric (and optionally underlying elastomeric membrane) which provides the sheet with generally constant properties. This tends to reduce the wear and provide increased longevity to the demarcations.

To provide cushioning and immersion for the patient, patient support 10 includes one or more cushioning layers for supporting a patient's body. Optionally, patient support 10 includes a cushioning system formed from a plurality of cushioning layers that are configured to be mechanically interconnected at least about or along one axis) so that the layers work together at least in one or more directions. In the illustrated embodiment, patient support 10 includes a bladder layer 26 with a plurality of bladders, which provide support to the patient's thighs, seat, back, and head, and an optional gel layer, for example, which provides support to the patient's heels. Bladder layer 26 and gel layer may be supported by a foam crib 30, which together may form a cushioning system for patient support 10. Crib 30 tends to keep the softer cushion layers of the bladders and gel in place while also providing a firmer rail along both sides of support 10. Optionally, the bladders of bladder layer 26, the gel layer and/or foam crib each have surfaces or structures that interconnect them together at least in one direction so that the bladders, gel layer, and foam crib may work in unison in one degree or another. Additionally, the side rails of the foam crib, which form bolsters, may be raised or angled upwardly relative to the top surface of the bladder layer, over at least a portion of the bladder layer, to form a cradle so that when the patient is lying on the bladder and gel layers, the foam crib will cradle the patient and further provide lateral support to the patient to reduce the risk of the patient rolling or falling from the patient support even when the side rails are lowered. For further details of optional bladder layers, gel layers, and foam cribs, and, for example, how they may be mechanically connected, reference is made to copending U.S. patent applications Ser. Nos. 61/697,010 and Ser. No. 14/019,353, referenced above.

The cushioning system may have multiple zones. For example, the bladders themselves may be arranged in zones, which optionally may be independently controlled with the inflation/deflation of each zone independent of the other zone or zones. The zones may include a head zone at the head end of support 10 formed by one group of bladders, a back zone at the back section of support 10 formed by another group of bladders, seat and thigh zones at the seat and thigh sections formed by a third group of bladders, and a heel zone at the foot end of patient support 10 formed by the gel layer. Further, each zone may be divided, for example into a left sub-zone and a right sub-zone so that when a patient is being turned, the pressure on the bladders on one side may be adjusted (e.g. increased or decreased) to accommodate the motion of the patient. For example, in the illustrated embodiment, the seat zone includes a right seat zone and a left seat zone to facilitate turning the patient. In the illustrated embodiment, the back zone and the head zone are grouped together and, further, positioned so that they will generally be aligned together when the patient is positioned on support 10. For further details of the bladder arrangement, materials, and/or construction, reference is made to copending U.S. patent applications Ser. No. 61/697,010 and Ser. No. 14/019,353, referenced above; Ser. No. 13/022,326, filed Feb. 7, 2011, entitled PATIENT/INVALID HANDLING SUPPORT; Ser. No. 13/022,372, filed Feb. 7, 2011, entitled PATIENT/INVALID HANDLING SUPPORT; Ser. No. 13/022,382, filed Feb. 7, 2011, entitled PATIENT/INVALID HANDLING SUPPORT; Ser. No. 13/022,454, filed Feb. 7, 2011, entitled PATIENT/INVALID HANDLING SUPPORT; Ser. No. 13/548,591, filed Jul. 13, 2012, entitled PATIENT/INVALID HANDLING SUPPORT, all of which are incorporated by reference herein in their entireties and commonly owned by Stryker Corporation of Kalamazoo, Mich.

Optionally, as described in copending U.S. patent applications Ser. Nos. 61/697,010 and Ser. No. 14/019,353, patient support 10 may include a pair of turning bladders. The turning bladders are positioned beneath crib 30 but within cover 14. To reduce friction between the bladders and crib 30, which is formed from a foam material, optionally, portions of crib may include a fabric overlay or wrap 32 (see FIGS. 2 and 3). The fabric may comprise a low friction material, such as nylon, to reduce the drag on the bladders and also reduce the wear on the foam. The pump or pumps that supply air to the turning bladders as well as the support bladders tubing are optionally located in a box 40 at the foot end of the support, and further beneath the foot end of crib 30 under gel layer 28. Again for further details of support cushioning layer and the components that may be located in cover 14, reference is made to copending U.S. patent application Ser. No. 61/697,010 and Ser. No. 14/019,353.

Referring again to FIG. 2, cover 14 includes an upper cover portion 50 and a lower cover portion 52 that are joined together by a zipper 54, which allows access to the various components inside support 10. Upper cover portion 50 includes an upper side, which may be formed from a separate panel, and upper side portions that extend downwardly (as shown in FIGS. 2-5) from upper side and optionally are formed from separate panels that are joined with the upper panel, for example by welding, stitching or the like. Similarly, lower cover portion 52 includes a lower side, which may be formed from a separate lower panel, and lower side portions that extend upwardly (as shown in FIGS. 2-5) from the lower side and optionally are formed from separate panels that are joined with the lower panel, for example by welding, stitching or the like. In the lustrated embodiment, the upper side of the cover is configured to follow the surface topology of the underlying cushion or cushioning system to provide a smooth surface, which can facilitate cleaning.

However, to accommodate the increase in thickness in the cushioning system, for example, when one of the turning bladders is inflated, one or more of sides 14*a*, 14*b*, as well as head end 14*c*, of cover 14 are adapted or configured to contract or expand to allow the upper side or panel to remain generally smooth even when the patient support undergoes a change in its surface topology. It has been found that covers with loosely fitting top sheets, which accommodate the change in shape of the underlying cushioning system or layer by providing excess material on the top sheet, for example, when turning a patient, tend to bunch up, which can make them hard to clean and, moreover, result in the excess fabric shifting to one side. As a result, the excess fabric may no longer be available to provide slack for the other side of the mattress. In addition, these folds or bunched areas of fabric can cause an increase in pressure on the patient's skin, which could potentially lead to pressure ulcer formation.

Figure 3:
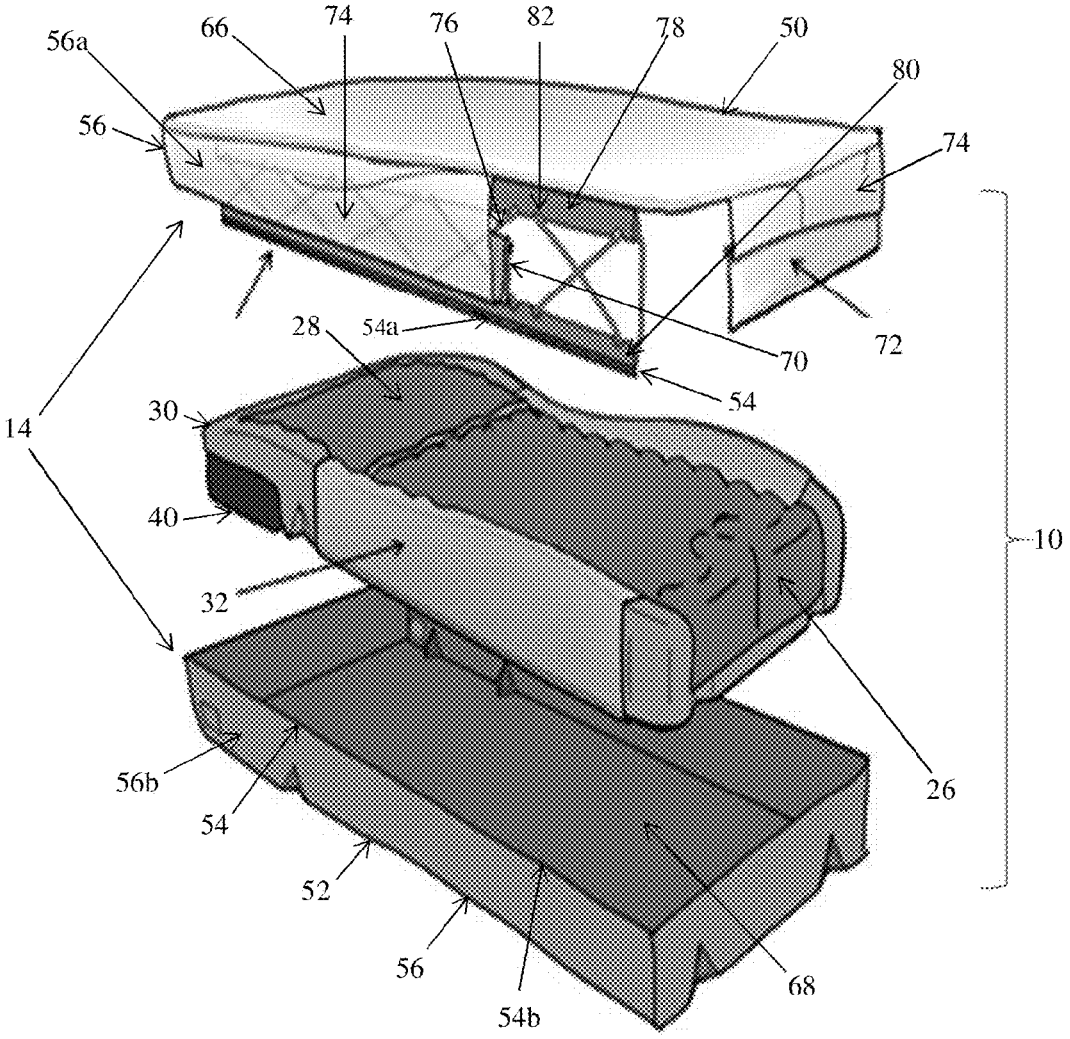
FIG. 3 is similar view to FIG. 2.
Figure 4:
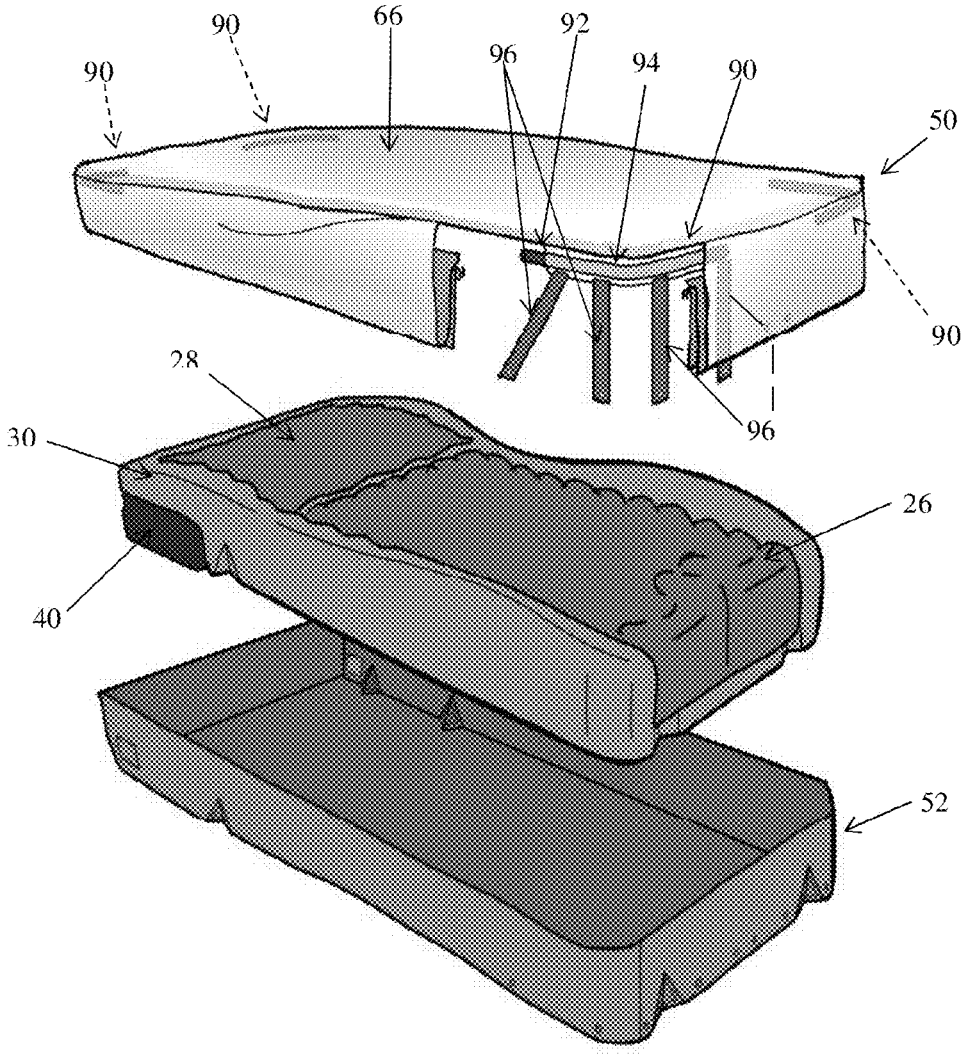
FIG. 4 is a similar view to FIG. 3 illustrating optional cover tie downs.

Referring to FIGS. 2-4, each side (e.g. side panels 56 and 58) and each end (e.g. end panels 60 and 62) of cover 14 is joined with the top (e.g. upper panel 66) and the bottom (e.g. lower panel 68) of cover 14. As noted above each top, bottom, sides, and ends may be formed from separate panels. Though it should be understood that one or more of the sides, ends, top or bottom may be formed by the same panel. Side panels 56 and 58 extend along the sides of the patient support and cushioning system, with the end panels 60, 62 extending there between. Each side panel 56 and 58 and each end panel 60 and 62 has an upper edge joined with the upper panel forming the top and a lower edge joined with the lower panel forming the bottom by interfaces, for example by seams. Though, as noted, some of the panels may be formed from an extension or extensions of the upper or lower panels, and therefore formed from the same material forming the upper or lower panels rather than comprising separate panels. Further, the side panels and head end panels are configured so that their upper and lower edges separate and/or diverge to lengthen and extend the respective side panels and head end panel so that cover 14 can accommodate variations in height of the mattress to allow the upper panel to remain generally smooth, as noted, even when the mattress undergoes a change in its surface topology.

Further, as noted, each side panel 56, 58 may include an upper side panel portion 56*a*, 58*a* and a lower side panel portion 56*b*, 58*b*, where the upper side panel portions 56*a*, 58*a* are joined with the upper panel 66, and the lower side panel portions 56*b*, 58*b* are joined with the lower panel 68. Similarly, the end panels 60 and 62 may have upper end panel portions 60*a*, 62*a* and lower end panel portions 62*a*, 62*b* that respectively are joined with the upper and lower panels 66, 68. Zipper 54 then joins the upper side panel portions with the lower side panel portions, and joins the upper end panel portions to their respective lower end panel portions.

In addition, the upper side panel portions 56*a*, 58*a* and upper end panel portions 60*a*, 62*a* may each include a flap or panel 70, 72 (only two shown, but it should be understood that the other side and end also has a similar flap or panel) of fabric extending over the zipper when the zipper is closed. For example, the flap may be formed by a folded loop of fabric, including the same fabric that is used to form the upper end panel portions and the upper side panel portions. In this manner, flaps 70 and 72 each form a watershed over the zipper to limit liquid intrusion through the zipper.

In the illustrated embodiment, each side and the head end further includes a fold 74 that unfolds (or at least partially unfolds) when the cushioning layer increases in height to allow the upper side of cover 14 to raise with the upper surface of the cushion layer and also allows it to remain generally smooth and move with the upper surface of the cushion layer unencumbered by the sides. In this manner, the sides and head end unfold from an unexpanded configuration to an expanded configuration when the cushioning layer increases in height, for example, when it is raised to turn a patient. Further, it should be understood that depending in the increase in height in the cushioning layer, it may be that only a portion of one of the folds partially unfolds.

In the illustrated embodiment the folds are provided on the upper side panel portions and the upper head end panel portion. For example, the folds may be made from the material that forms the upper side panel portions and the upper head end panel portion or may be formed by separate panels or sheets of material that are attached, for example by stitching, welding, or the like.

Optionally, the folds may be biased in their non-expanded configuration such that when the cushioning layer decreases in height, the folds will generally return to their non-expanded configuration. "Generally return to its non-expanded configuration" means that the fold may not assume the exact same fold, but it will resume to a non-expanded, folded configuration that is generally similar to its original non-expanded configuration.

For example, again referring to FIGS. 2 and 3, the folds may be biased in their un-expanded configuration by one or more elastic strands 76. A suitable elastic strand may be in form of a fabric covered elastic or rubber cord, such as a bungee. The strand or strands may extend between the upper panel and the lower panel. In the illustrated embodiment, strand 76 is threaded through upper and lower straps or panels 78, 80, which are respectively joined to upper panel 66 and lower side panel portions 56*b*, 58*b* and to lower head end panel portion 60*b*. For example, panels 78 may be secured to upper panel 66 by adhesive, removable fasteners, such as hook and loop patches (e.g. VELCRO patches) or snaps, stitching or welding, depending on the materials. Lower panels 80 are joined to upper portion 54*a* of zipper 54 so that when upper portion 54*a* of zipper is joined with lower portion 54*b* of zipper 54, strand 76 extends between the upper and lower panels 66, 68 of cover 14 to thereby bias folds 74. In this manner, when the upper side of the mattress raises relative to the lower side, the strand or strands are stretched. Further, fold 74 in the upper side panel portion that is adjacent the side of the mattress that is being raised at least partially unfolds. When the mattress is no longer in a raised position and the strand or strands pull on the upper panel 66 to return it its un-raised position, the stand or strands also urge the folds in the upper head end panel portion and the upper side panel portion (on the side that is deflating) to generally return their unexpanded configuration.

Referring again to FIG. 2, strand 76 may be threaded though grommets 82 mounted in panels 78 and 80 and further is anchored at its ends to panels 78 and 80 by cord or barrel locks 76*a*. While illustrated as being formed by a single stand that threads through the grommets in panels 78 and 80, it should be understood that two or more strand may be used.

In addition, strands 76 may extended vertically between the upper side panel and the lower side panel. Alternately, as shown, strands 76 may be angled so that they have an increase length between the upper and lower side panels, which provides an increase in stretch for a given strand.

Figure 5:
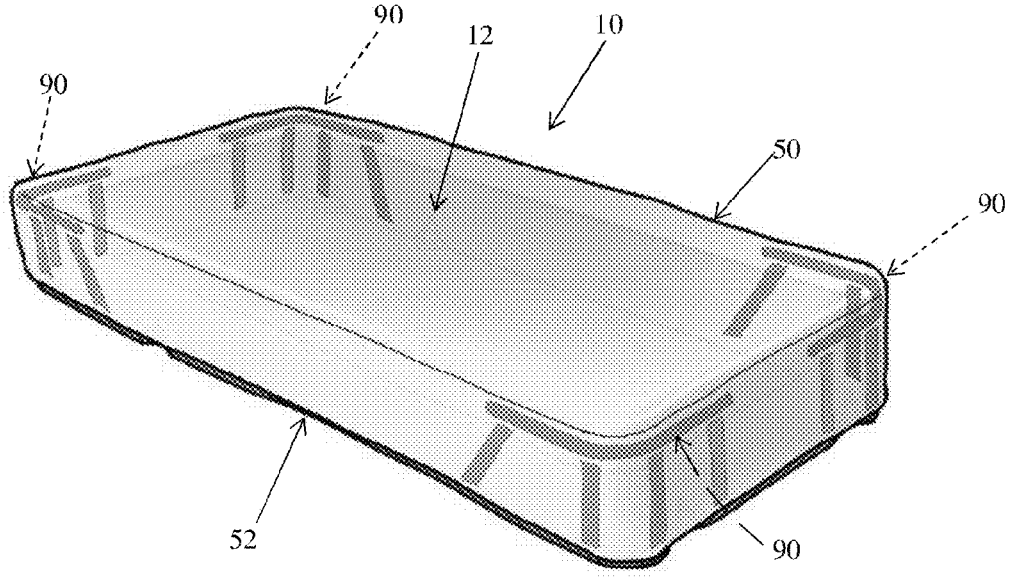
FIG. 5 is a perspective view of the cover shown over a patient support showing the optional tie down locations.

To further facilitate the retention of the corners of cover 14 during a turning event, for example, each corner may incorporate an anchor or anchoring assembly 90. Optionally, to facilitate the anchoring of the corners, the corners may be stiffened or reinforced. For example, as best seen in FIG. 5, anchoring system 90 includes a reinforcing member 92, such as plastic tube, which is configured with a rounded angle shape. The reinforcing member may be mounted to upper panel 66, for example, in a loop or loops of material that form a channel through which member 92 can be inserted. The loop or loops may then be attached, for example by way of stitching, an adhesive, welding or the like to a plurality of tie downs such as straps 96, which are then secured at their opposed ends to lower cover portion 52, for example, to lower panel 68, either by stitching, welding, releasable fasteners, such as hook and loop fasteners or snaps. In this manner, when the cushioning system is raised by the turning bladder or bladders, the corner on the side that is being lifted will generally remain at a fixed height as controlled by the length of straps 96. Straps 96 may be non-stretching or may have some limited elasticity, or a combination of both may be used. For example the straps or tie downs that are closer to the corner may be non-stretchy, while the tie downs or straps that are located at the sides may have some elastic characteristics.

As noted above, crib 30 may be wrapped or covered with a layer of fabric. The fabric may also protect the foam from the strands and tie downs, which may also form wear points on the foam if not protected.

Figure 6:
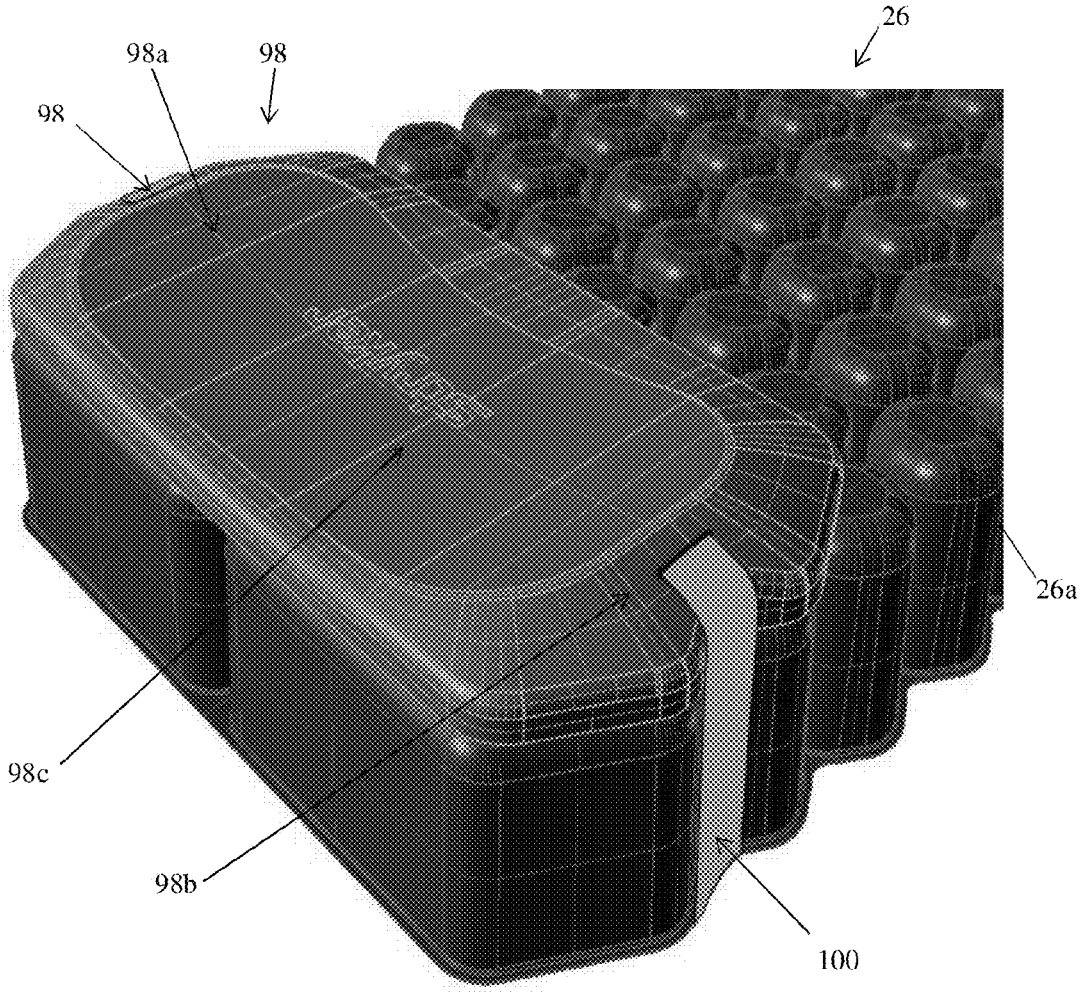
FIG. 6 is a perspective view of a head end of the patient support, which is shown with bladders, with a head cushion mounted to the head end.
Figure 7:
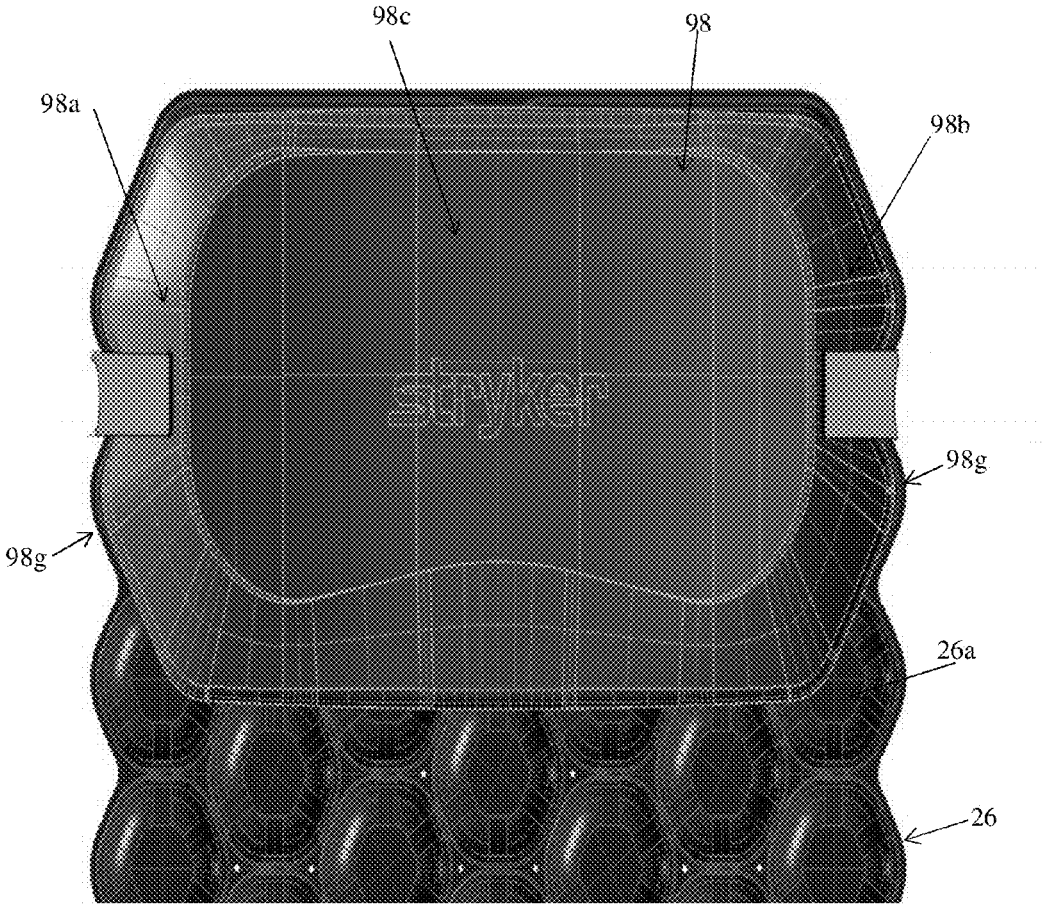
FIG. 7 is a plan view of the head end of the patient support in FIG. 6.
Figure 8:
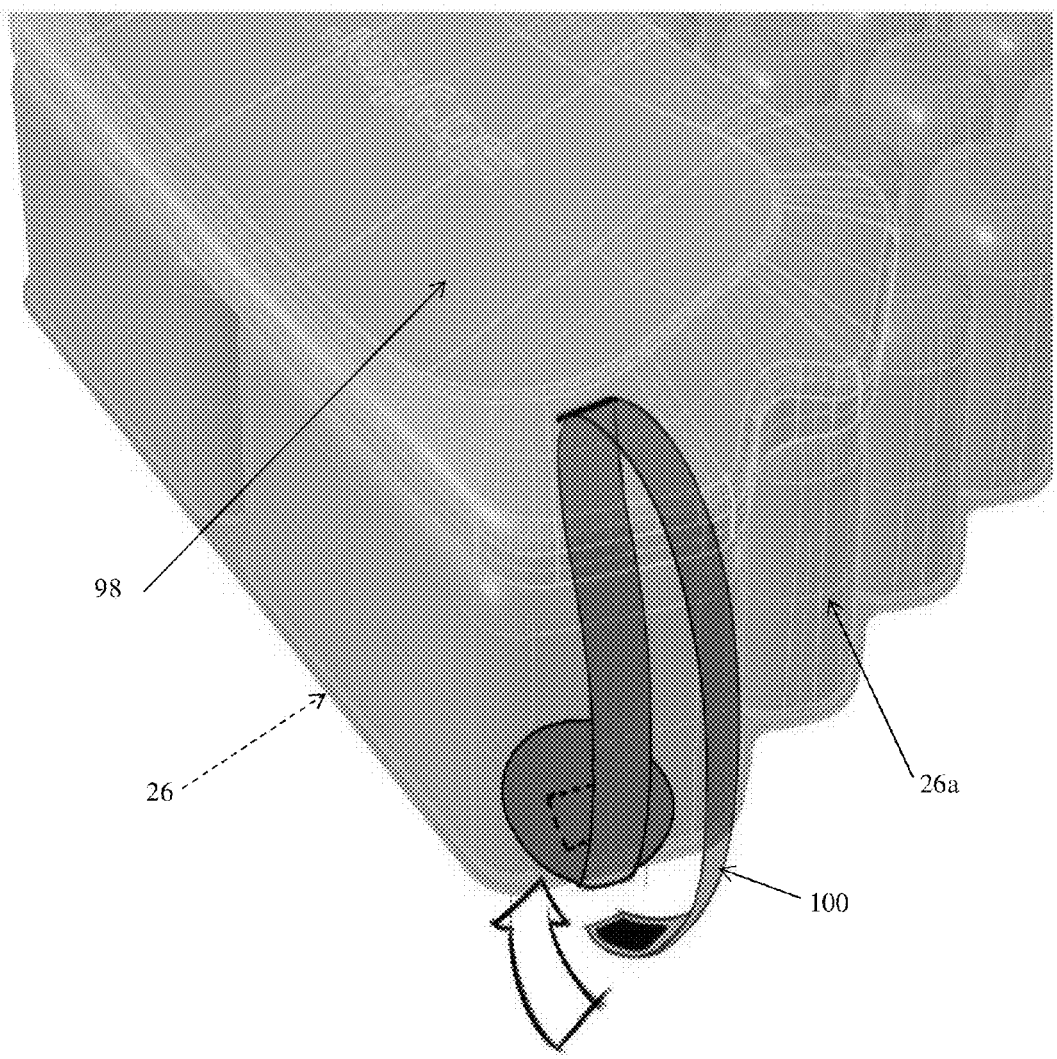
FIG. 8 is a similar view to FIG. 6 with the patient support and cushion shown in phantom to illustrate an anchoring system for the cushion.

Referring to FIGS. 6-8, patient support 10 may optionally incorporate a cushioning layer 98 on top of bladder layer 26. For example, in the illustrated embodiment, cushioning layer 98 may be configured as a head end cushion and secured to head end of bladder layer 26 by straps 100. Cushioning layer 98 may be formed from soft foam, such as urethane foam. A suitable urethane foam includes 2.5 lb. expanded urethane foam.

Figure 9A:
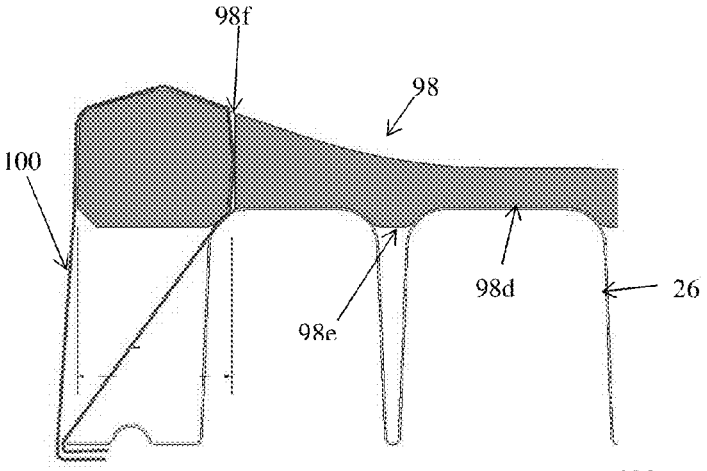
FIGS. 9A-9C illustrates various strap configurations for securing the head end cushion to the underlying bladders.
Figure 9B:
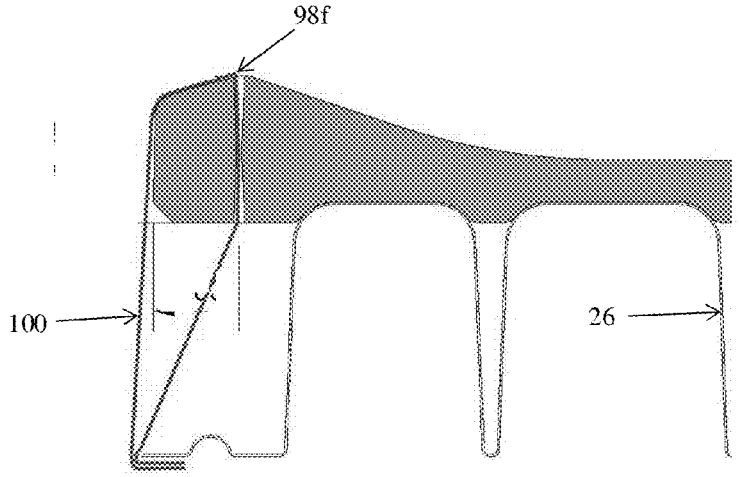
Figure 9C:
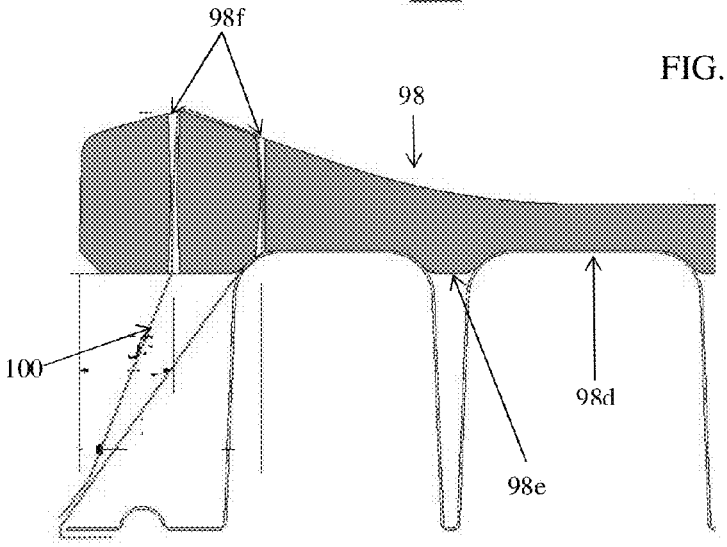

Cushioning layer 98 may be contoured to provide raised or sloping sides 98*a*, 98*b*, which cradle and help support a patient's head, especially during a turn. The central portion 98*c* of cushioning layer 98 may be generally flat or form a slight concave region, which transitions to the sides with a smooth curve. The upper end of cushioning layer 98, which is closer to the head end of bladder layer 26, may be slightly raised (see FIGS. 9A-9C), while the lower end, which would be generally aligned under the neck of a patient, may also be slightly raised. In this manner, the head of the patient is cradled by cushioning layer 98. For example, when a person is lying on their back and generally centered on the patient support, but then turns, the cushioning layer can support the person's head so that it will remain generally aligned with the person's spinal cord.

In addition to securing layer 98 to bladder layer 26 by straps 100, which extend through cushioning layer 98 (see FIGS. 9A-9C for optional configuration), cushioning layer 98 may also be configured so that its lower surface follows the surface topology of one or more bladders 26*a* of bladder layer 26 to further secure the position of the cushioning layer. For example, referring to FIGS. 9A-9C, the underside of cushioning layer 98 may have one or more recesses 98*d*, formed in the lower surface of the foam, which generally follow the surface topology of one or more of the bladders. As a result the lower surface also forms portions 98*e* that depend from the lower surface to extend between at least two of the bladders to thereby form a mechanical coupling between cushioning layer 98 and the bladder layer.

Figure 10:
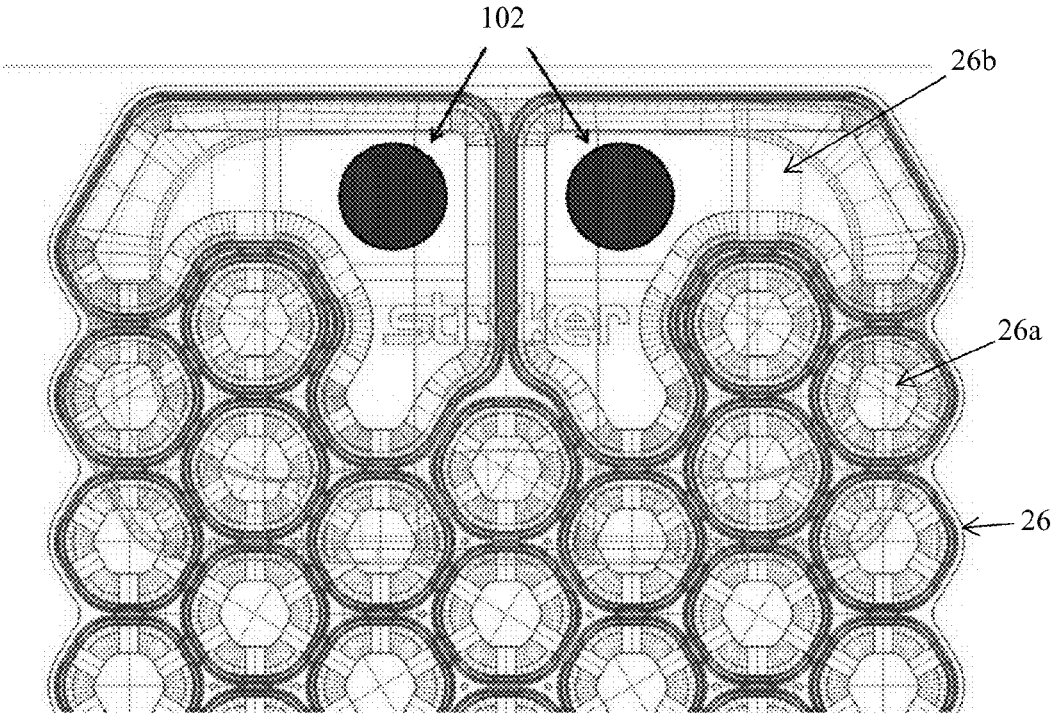
FIG. 10 is a plan view of an alternative configuration of the head end of the patient support.

Optionally, as best seen in FIG. 10, bladder layer 26 includes enlarged bladders 26*b* at the head end to form right side and left side bladders. Additionally, each bladder 26*b* may include a releasable fastener 102, such as hook and loop (e.g. VELCRO) patches, which engages similar patches provided on the underside of cushioning layer 98 to further secure cushioning layer 98 in place.

Referring again to FIGS. 9A-9C, strap 100 may form a loop around a portion of cushioning layer 98 which is then anchored, for example, under bladder layer 26. As shown, cushioning layer 98 may include one or more channels 98*f* formed therein for the strap 100 to pass through and secure it in place.

In addition, as best seen and understood from FIG. 6, the sides 98*g* of cushioning layer 98 may be configured to follow the shape of the sides of bladder layer 26 so that cushioning layer 98 also mechanically couples to the foam crib as described in copending U.S. patent application Ser. No. 61/697,010, filed Sep. 5, 2012, entitled PATIENT SUPPORT. Thus, the cushioning system provides a series of layers that are mechanically interconnected or coupled so that the system can operate together to provide support to the patient.

Referring again to FIGS. 2 and 2A, as described in the above referenced applications, foam crib 30 together with bladder layer 26 and gel layer 28 define a surface topology of the patient support, which in the illustrated embodiment is non-planar. For example, foam crib 30 includes side rails 160 that project upwardly and have angled surfaces relative to the top surface of the bladder layer to form a cradle for a person supported in patient support 10. Further, the head end of the patient support, as noted above, may have a cushion 98, which is also contoured. Optionally, the upper edge of side rails 160 may also be contoured so that height of the side rails 160 is greater at the head end near or at the shoulder height of a person lying on support 10.

Figure 2A:
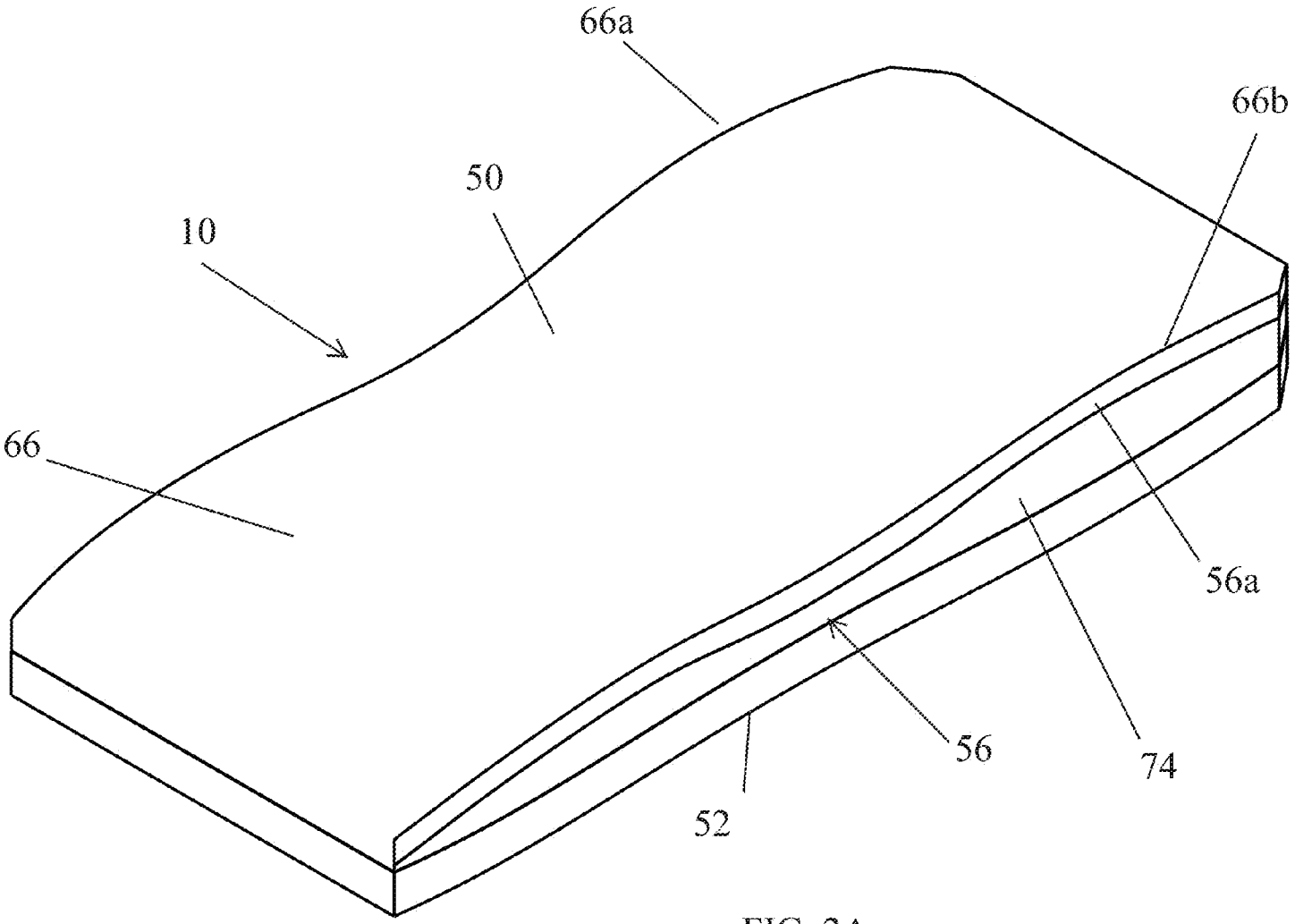
FIG. 2A is a perspective view of the patient support and cover of FIG. 1.

In the illustrated embodiment, cover 50 is configured to generally follow the surface topology of the underlying cushioning layer. Though described as being formed from the bladder layer, the gel layer and the foam layer (e.g. the foam crib), it should be understood that the underlying cushioning layer may also be formed from any one of a bladder layer, a gel layer, or a foam layer, or a combination thereof. As best seen in FIG. 2A, upper side panel 66 may be joined with sides 56 and 58 by non-linear interfaces 66*a* and 66*b*, such as seams. Interfaces 66*a* and 66*b* generally follow the topology of the underlying cushion layer and include curved portions at both the head end and the foot end of the cover. In this manner, as noted above, upper side panel 66 can therefore follow surface topology of the underlying cushion or cushioning system to provide a smooth surface, which can facilitate cleaning and further reduce the likelihood of forming folds or bunching up of the cover at the interface with the person lying on the support. Thus, cover 50 may be tailored to at least generally follow the contours of the underling cushioning layer or layers so that there is no straight line at least at the interface with the person lying on the support.

While several forms of the invention have been shown and described, other changes and modifications will be appreciated by those skilled in the relevant art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. A patient support comprising:

a mattress; and a cover, the cover including an upper panel of flexible fabric extending over a top side of the mattress, a lower panel extending under a bottom side of the mattress, and end panels and side panels joined with the upper panel and with the lower panel, the side panels each extending along a respective side of the mattress and having upper and lower edges, the upper edges of the side panels being joined with the upper panel, the lower edges of the side panels being joined with the lower panel, and the side panels being configured to prevent liquid intrusion into the mattress and further so that their upper and lower edges separate and/or diverge to accommodate variations in height of the mattress to allow the upper panel to remain generally smooth even when the mattress undergoes a change in its surface topology, wherein the side panels each include a fold, the folds at least partially unfolding from an unexpanded configuration to an expanded configuration when the side of the mattress to which it is adjacent increases in height.

2. The patient support according to claim 1, wherein the cover includes a zipper.

3. The patient support according to claim 2, wherein each of the side panels includes an upper side panel portion and a lower side panel portion, the upper side panel portions are joined with the upper panel, the lower side panel portions are joined with the lower panel, and the zipper joins the upper side panel portions with the lower side panel portions.

4. The patient support according to claim 3, wherein the upper side panel portions each include a flap of fabric extending over the zipper when the zipper is closed.

5. The patient support according to claim 4, wherein each flap is formed by a loop of fabric.

6. The patient support according to claim 1, wherein each of the folds is biased in its non-expanded configuration such that when the mattress increases in height, at least a portion of one fold of the folds will at least partially unfold, but when the mattress decreases in height, the one fold will generally return to a non-expanded configuration.

7. The patient support according to claim 6, wherein each of the folds may be biased in its un-expanded configuration by one or more elastic strands.

8. The patient support according to claim 7, wherein the one or more elastic strands extend between the upper panel and the lower panel.

9. The patient support according to claim 1, wherein the mattress includes a plurality of inflatable bladders.

10. The patient support according to claim 9, wherein the inflatable bladders are supported on a foam crib.

11. The patient support according to claim 9 further comprising turning bladders positioned in the cover beneath the inflatable bladders.

12. A patient support comprising:

a cushioning layer; and a cover with an upper side extending over the cushioning layer and two sides joined with the upper side, the two sides extending along the sides of the cushioning layer and secured at a bottom side of the cushioning layer, and the two sides being configured to fold or unfold to accommodate variations in height of the cushioning layer to allow the upper side of the cover to remain generally smooth even when the cushioning layer undergoes a change in its surface topology.

13. The patient support according to claim 12, wherein the cushioning layer comprises a cushioning system, said cushioning system including a bladder layer or a gel layer or a foam layer or a combination of a gel layer and a foam layer.

14. The patient support according to claim 12, wherein the sides are secured at the bottom side of the cushioning layer by a bottom panel that extends under the bottom side of the cushioning layer.

15. The patient support according to claim 12, wherein the cover is formed from an upper panel, the upper panel forming the upper side, and the two sides are formed by side panels joined with the upper panel.

16. The patient support according to claim 15, wherein the cover further includes a bottom panel joined with the side panels.

17. The patient support according to claim 15, wherein the upper panel is formed from a liquid impermeable material.

* * * * *